United States Patent [19]

Johnson

[11] Patent Number: 4,515,369

[45] Date of Patent: May 7, 1985

[54] DICE AND BLACKJACK GAME BOARD

[76] Inventor: Ernest L. Johnson, Box 44, Fraser, Colo. 80442

[21] Appl. No.: 443,706

[22] Filed: Nov. 22, 1982

[51] Int. Cl.[3] ..... A63F 3/00

[52] U.S. Cl. ..... 273/243; 273/248

[58] Field of Search ..... 273/285, 248, 274, 243

[56] References Cited

U.S. PATENT DOCUMENTS

| | | | |
|---|---|---|---|
| 626,853 | 6/1899 | Boig | 273/274 |
| 705,873 | 7/1902 | Schinkel | 273/285 X |
| 798,170 | 8/1905 | Cross | 273/285 X |
| 2,012,140 | 8/1935 | Popper | 273/285 |
| 2,562,822 | 7/1951 | Sanger | 273/248 X |
| 2,658,760 | 11/1953 | Brost | 273/285 X |
| 3,148,886 | 9/1964 | Sharp | 273/248 X |
| 3,693,977 | 9/1972 | de Keller | 273/248 |
| 3,829,098 | 8/1974 | Umminger, Jr. | 273/274 X |

FOREIGN PATENT DOCUMENTS

| | | | |
|---|---|---|---|
| 673136 | 6/1952 | United Kingdom | 273/274 |
| 1070900 | 6/1967 | United Kingdom | 273/248 |

*Primary Examiner*—Richard C. Pinkham
*Assistant Examiner*—Scott L. Brown
*Attorney, Agent, or Firm*—William H. Wright

[57] ABSTRACT

This invention relates to game boards in general, and more specifically to a game board that combines the elements of "craps" and "blackjack" into a single combined game, wherein the rules of blackjack apply to the movements of the game pieces, but the increment of movement is determined by the rolling of the die. In addition, the game board and game pieces cooperate to provide movable obstructions to alter the path of travel of a pair of dice thrown upon the game board.

8 Claims, 3 Drawing Figures

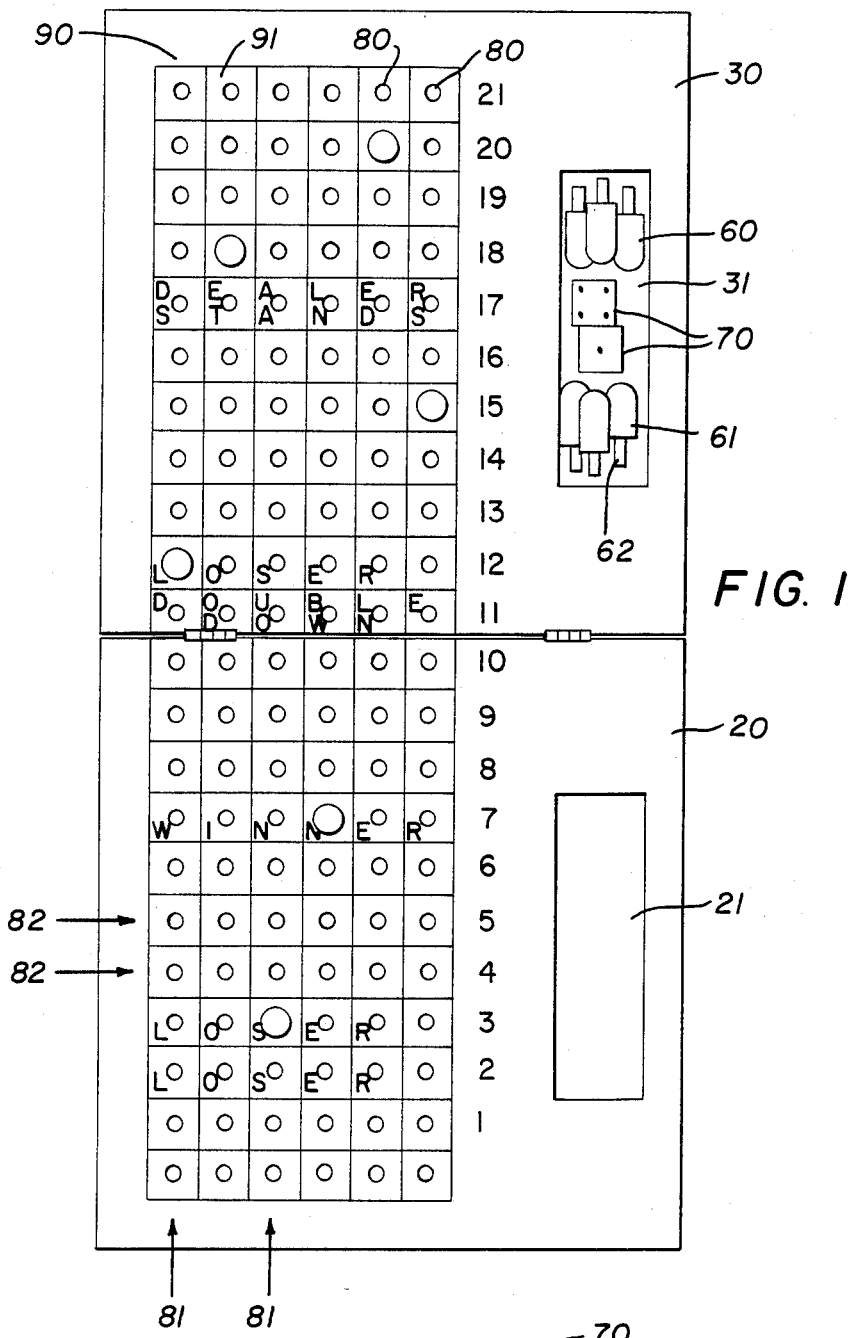
FIG. 1
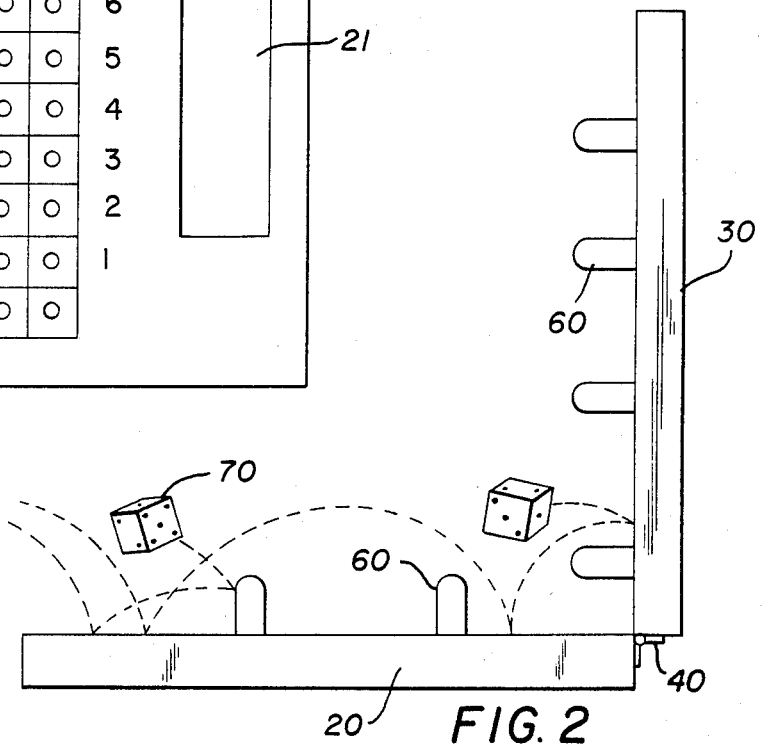
FIG. 2
FIG. 3
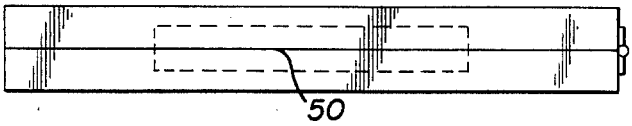

DICE AND BLACKJACK GAME BOARD

BACKGROUND OF THE INVENTION

While the prior art is replete with game boards, wherein the movement of the game pieces on the game board are dictated by the rolling of a single die or a pair of dice in accordance with pre-established rules, as can be seen by reference to U.S. Pat. Nos. 4,234,185; 3,744,800; 3,642,285 and 3,989,243; none of the game boards to date have combined the elements of two of the most well recognized games of chance; i.e., the card game commonly referred to as "21" or "blackjack", and the dice game commonly referred to as "craps".

Also none of the prior art devices have envisioned a game board wherein the game pieces, by virtue of their disposition on the game board, produce stationary and movable obstacles to the passage of dice along the game board surface. In addition, none of the prior art devices have contemplated increasing the number of obstacles on a game board surface, in direct proportion to the number of people playing the game, so that the first player is confronted with the least number of obstacles, and the last player is confronted with the greatest number of obstacles.

SUMMARY OF THE INVENTION

An object of the present invention is the provision of a new game board, wherein the movement of the pieces and the determination of the winner or winners of the game are predicated on the combined rules of two extremely popular game of chance to produce an entirely new game.

Another object of the present invention is the provision of a new and unique cooperation between a game board, the playing pieces and a pair of dice, wherein the position of the game pieces on the game board, and/or the disposition of one of the game board segments with respect to the remainder of the game board will alter the path and direction of a pair of dice thrown onto the game board surface.

Still another object of the present invention is the provision of a game board; wherein the disposition of the playing pieces on the game board produces movable obstructions on the game board surface that will alter the path of travel of a pair of dice thrown along the game board, and wherein the dice are thrown to determine the increment of travel of the game pieces on the game board.

Yet another object of the present invention is to provide a game board having one segment pivotally mounted with respect to the other segment, wherein the one segment will present an impact surface, that will reverse the path of travel of a pair of dice traversing the other segment, whereby the dice are used to determine the increment of movement of game pieces movably mounted on the game board.

A yet another object of the present invention is to provide a game board that will allow the players to enjoy and employ the strategy and techniques involved in both "blackjack" and "craps" while in reality playing an entirely new game.

These and other objects, advantages and novel features of the invention will become apparent from the detail description that follows when viewed in conjunction with the accompanying drawings.

BRIEF DESCRIPTION OF THE DRAWINGS

FIG. 1, is a top plan view of the game board and game pieces in use in the game boards fully extended position.

FIG. 2, is a side plan view of the game board and game pieces in use in the game boards partially folded position.

FIG. 3, is a side plan view of the game board in its folded position.

DETAIL DESCRIPTION OF THE PREFERRED EMBODIMENT

As can be seen by reference to FIG. 1, the dice and blackjack game board, is designated generally as 10, and comprises two game board segments 20 and 30, that are pivotally connected via hinge means 40.

Each of the segments 20 and 30, are provided with complimentary enlarged recesses 21 and 31, along one side, which are designed to cooperate with one another to form a compartment 50, used to store the game pieces 60 and the pair of dice 70, when the two segments are folded together as illustrated in FIG. 3.

Each of the segments 20 and 30, comprise an elongated flat rectangular member 22, and 32 having a plurality of apertures 80, disposed therein. The segments 20 and 30, in the preferred embodiment are fabricated from wood; however, hard plastic would be an equally acceptable substitute.

The apertures 80, on each of the segments 20 and 30, are defined by a grid 90, and arranged in parallel rows that run the length of the respective segments. Each of the rows 81, contains eleven equidistant spaced apertures 80, and the apertures in adjacent rows are laterally aligned, centered within the grid squares 91, and spaced an equal distance apart.

As can best be seen by reference to FIG. 1, at least one row of apertures on segment 20, is numbered from zero to ten (0–10), in vertically ascending order, and at least one row of apertures on segment 30, is numbered from eleven to twenty-one (11–21), in vertically ascending order.

In the preferred embodiment, there are six rows 81, of apertures 80, running the length of the two segments, and legends are imprinted across the lateral columns 82, formed by the rows 81, to coincide with various numbers between zero and twenty-one. The laterally aligned columns of apertures numbered two, three and twelve bear the legend "LOSER". The laterally aligned column of apertures numbered seven bears the legend "WINNER". The laterally aligned column numbered eleven bears the legend "DOUBLE DOWN" and the lateral column numbered seventeen bears the legend "DEALER STANDS".

The game pieces 60, are in the form of elongated pegs 61, having a reduced diameter portion 62, that is dimensioned to frictionally, yet releasably engage the sides of the apertures 80. The number of game pieces 60, will be equal to the number of vertical rows 81, formed on the game board 10. The external configuration of the game pieces 60, may be identical as illustrated in the drawings, or they can be individually contoured and colored distinctly so that the players can readily identify their own pieces.

The game begins with all of the players having their game pieces inserted into the lateral column numbered zero. A pair of dice 70, are rolled along the game board surface to determine the increment of advancement of the individual game pieces along their respective vertical row of apertures. The players take turns from left to right advancing their game pieces until the last player has taken their turn. As the game progresses and the game pieces 60, are advanced along the game board, the individual game pieces provide an increasing number of obstacles to the passage of the thrown pair of dice 70, along the game board surface.

When the first player starts all of the game pieces are disposed in the column numbered zero, so that the dice 70, can be rolled along the length of the game board unimpeded. Once the first player has advanced his or her game piece along the board, that game piece will then become an obstacle for the rolled dice on succeeding throws, and contact of the die with one or more of these obstacles will invariably alter the results of the throw, from what would have resulted had the obstacles not been present.

It can be seen therefore that the first player will only be faced with a single movable obstacle, while each succeeding player will be faced with a number of obstacles in direct proportion to the number of players including themselves that have rolled the die. This feature adds another factor of unknown probability to the throwing of the die.

Due to the fact that the game board comprises two hinged segments 20 and 30, the game board 10, can be disposed in the manner illustrated in FIG. 2, wherein segments 20, is resting on a horizontal surface such as a table or floor and segment 30, is supported by hinge means 40 a vertical surface such as a wall (not shown). In this configuration the segment 30, will provide an enlarged stationary impact surface that will reverse the direction of the die that have traversed the length of the segment 20. In this mode, of use the game pieces disposed on segment 20, will present vertically disposed obstacles, while the game pieces disposed on the segment 30, will present horizontally disposed obstacles. The thrown die that do not encounter an obstacle on segment 20, will invariably strike the impact surface on segment 30, and may even encounter and be deflected by one of the horizontally disposed game pieces thereon. Obviously, this arrangement will also add a factor of unknown probability to the throw of the die.

The object of the game is very simple; i.e., each player attempts to advance their game piece as close as possible to a score of "21" without going over that number or "going bust". The game is started by giving each player an equal amount of poker chips with which to wager. The players roll the die for high score, with the winner becoming the Dealer or Banker. In the case of a tie, the players involved will roll the die again. The player to the left of the Dealer takes the left peg, places his wager at the bottom of the board under his peg, and rolls the dice. If he rolls a 2, 3, or 12, on his first roll, he "craps out" and loses his bet immediately to the Dealer. If he rolls a 7, on his first roll, he wins and Dealer must pay the player, matching his bet. If Dealer also rolls a 7, on his first roll, they tie and neither pays. If the player rolls a number other than 2, 3, 12, or 7, he places he peg in the corresponding number hole. He may continue rolling or stand. Should the player "bust" he pays the dealer the amount bet and replaces his peg in the starting hole.

The player to his left begins his turn and uses the peg second to left. The Dealer always plays last, using peg to the far right of the board.

If a player rolls an 11, he has the option to "double down", that is, double his bet and roll one more time.

A player may stand on any number he chooses, but the Dealer must roll again on 16 & under, and stand when his last roll gives him a score of 17 or over.

The Dealer or Banker changes hands to the first player to roll a 7, on his first roll, unless the Dealer should also roll a 7. In case of a tie the Dealer does not move.

Except for a 2, 3, or 12, any time a player and the Dealer has the same score it is a tie, or a "push". When the Dealer busts he pays all players that haven't busted or crapped out.

If the Dealer or Banker goes broke or "bankrupt" he begins paying the players to his left and pays as many as he can until he is broke. The first player that isn't paid in full takes over the Bank, becoming the new Dealer.

Having thereby described the subject matter of this invention it should be obvious that many substitutions, modifications and variations are possible in light of the above teachings. It is therefore to be understood that the invention as taught and described is only to be limited to the extent of the breadth and scope of the appended claims.

What I claim is:

1. An amusement device comprising a dice and blackjack game board and game pieces comprising:

a game board comprising two rectangular segments that are pivotally connected together, wherein each segment is provided with a plurality of parallel aligned rows of apertures and each row contains eleven apertures, at least one said aligned rows of apertures on each of the segments being provided with consecutive numbering from "one" to "twenty-one", and printed legends associated with the dice game commonly known as "craps" and the card game commonly known as "blackjack" appear adjacent to selected numbers; wherein said printed legends located adjacent said numbers indicate the result obtained by having said numbers in the games of "craps" and "blackjack";

a pair of dice adapted to be thrown across the length of at least one of said segments; and a plurality of elongated game pieces dimensioned to be received within said apertures, and to provide obstacles to the path of travel of said thrown dice.

2. The amusement device as in claim 1; wherein, the position of the obstacles on the game board are determined by the prior results of the rolled dice.

3. The amusement device as in claim 1; wherein, the incremental movement of the game pieces is determined by the roll of the dice.

4. The amusement device as in claim 1: wherein, each of the segments is provided with an enlarged, aligned, complimentary recess that forms a compartment when the two segments are folded together.

5. The amusement device as in claim 1; wherein, the rows of apertures are defined by a grid pattern having lateral columns and selected columns are provided with a said printed legends.

6. An amusement device as in claim 1; wherein, the other of said segments can be pivoted with respect to said at least one segment to produce a vertically disposed impact barrier for said rolled dice.

7. An amusement device as in claim 6; wherein, the game pieces disposed on said one segment provide vertically disposed obstacles to the passage of the dice, and the game pieces disposed on said other segment provide horizontally disposed obstacles to the passage of the dice.

8. An amusement device as in claim 7; wherein, the game pieces comprise elongated pegs that have a reduced diameter portion that is dimension to be received within said apertures.

* * * * *